US006537660B2

(12) United States Patent
Katayama et al.

(10) Patent No.: US 6,537,660 B2
(45) Date of Patent: Mar. 25, 2003

(54) LIGHT-WEIGHT FIBER EXCELLENT IN DYEABILITY

(75) Inventors: Takashi Katayama, Okayama Pref. (JP); Kazuhiko Maekawa, Okayama Pref. (JP); Hitoshi Nakatsuka, Okayama Pref. (JP); Ichirou Inoue, Okayama Pref. (JP); Shuhei Yorimitsu, Okayama Pref. (JP)

(73) Assignee: Kuraray Co., Ltd., Kurashiki (JP)

( * ) Notice: Subject to any disclaimer, the term of this patent is extended or adjusted under 35 U.S.C. 154(b) by 189 days.

(21) Appl. No.: 09/805,247

(22) Filed: Mar. 14, 2001

(65) Prior Publication Data

US 2002/0009938 A1 Jan. 24, 2002

(30) Foreign Application Priority Data

Mar. 14, 2000 (JP) ..... 2000-070174

(51) Int. Cl.[7] ..... D01F 6/00; D01F 8/00

(52) U.S. Cl. ..... 428/364; 428/370; 428/373; 428/395; 264/172.17

(58) Field of Search ..... 428/370, 364, 428/373, 395; 525/256, 299; 264/172.17

(56) References Cited

U.S. PATENT DOCUMENTS 5,464,695 A * 11/1995 Kawamoto et al. ..... 428/373
6,096,435 A * 8/2000 Maekawa et al. ..... 428/462
6,239,226 B1 * 5/2001 Fischer et al. ..... 525/256

FOREIGN PATENT DOCUMENTS

JP 10-501309 3/1998
JP 2001262433 A * 9/2001

* cited by examiner

*Primary Examiner*—N. Edwards
(74) *Attorney, Agent, or Firm*—Oblon, Spivak, McClelland, Maier & Neustadt, P.C.

(57) ABSTRACT

The present invention relates to a fiber, which includes:

2 to 95% by weight, based on the total weight of the fiber, of at least one block copolymer, which includes:

at least one polymer block (A) that includes 50 to 100% by weight of olefinic monomer units, based on the total weight of the block copolymer; and at least one polymer block (B) that includes 0.1 to 100% by weight of (meth)acrylic monomer units, based on the total weight of the block copolymer. Other embodiments of the invention include fibrous structures, non-woven fabrics, leather-like sheet materials, and dyed articles, which include the above-described fiber, and processes of making the above-described fiber. The present invention also relates to a composite fiber, and fibrous structures, non-woven fabrics, leather-like sheet materials, and dyed articles, which includes the above-described composite fiber, as well as processes for producing the above-described composite fiber.

17 Claims, No Drawings

LIGHT-WEIGHT FIBER EXCELLENT IN DYEABILITY

BACKGROUND OF THE INVENTION

1. Field of the Invention

The present invention relates to a synthetic fiber having both lightweight properties and excellent dyeability.

2. Description of the Background

Because of their excellent lightweight properties, strength and chemical resistance, polyolefin fibers are widely used in ropes, bundling yarns, filters, wipers, diapers and sanitary items, among others. In recent years, because of environmental considerations, the demand for polyolefin fibers as materials of high recyclability or as low combustion heat materials is increasing.

Although polyolefin fibers are lightweight and have good chemical resistance, they cannot be satisfactory dyed and, currently, polyolefin fibers are not widely used in clothing items. Although polyolefin fibers are used in producing items for nonclothing use, such as paper and nonwoven fabrics, they are not used in those fields of application where delicate shades or hues are demanded.

While merely colored polyolefin fibers can be obtained by incorporating a pigment into a resin composition and spinning the same, it is difficult for the fibers to take up a delicate shade or hue. To increase the variety of colors, dyeing with dyes is preferred; and therefore a number of proposals have been advanced to impart dyeability to polyolefin fibers. For example, a method has been proposed which includes subjecting a polyolefin together with a polyester or polyamide, which are dyeable, to mixed or composite spinning. With this method, dyeability is indeed improved, but because polyolefins adhere very poorly to polyesters or polyamides, interfacial peeling or color irregularities tend to occur in fibers made by this method, and this method has not been put to practical use. Further, there is a proposal according to which an ethylene/alkyl acrylate copolymer is blended with or grafted on polypropylene (JP Kohyo H1O-501309). The dyeability obtained with this method is not very satisfactory, however.

On the other hand, polyester fibers show good dyeability against disperse dyes and are thus widely utilized in both clothing and non-clothing items. However, since polyester fibers have a specific gravity of 1.38, the products produced using polyester fibers are undesirably heavy, especially when compared to textile materials made from polypropylene, which has a specific gravity of less than 1.0. That is a remaining problem.

SUMMARY OF THE INVENTION

Accordingly, it is an object of the present invention is to provide a fiber having excellent dyeability.

Another object of the present invention is to provide a fiber which is as lightweight as polyolefins and which has excellent dyeability.

Another object of the invention is to provide a fiber having good light fastness and washing fastness.

Another object of the present invention is to provide a fiber having excellent dyeability without impairing the lightweight property, strength and chemical resistance intrinsic in polyolefins such as polyethylene and polypropylene.

These and other objects have now been attained by the present invention, the first embodiment of which provides a fiber, which includes:

2 to 95% by weight, based on the total weight of the fiber, of at least one block copolymer, which includes:

at least one polymer block (A) that includes 50 to 100% by weight of olefinic monomer units, based on the total weight of the block copolymer; and at least one polymer block (B) that includes 0.1 to 100% by weight of (meth)acrylic monomer units, based on the total weight of the block copolymer.

Another embodiment of the invention provides a fibrous structure, which includes the above-described fiber.

Another embodiment of the invention provides a nonwoven fabric, which includes the above-described fiber.

Another embodiment of the invention provides a leather-like sheet material, which includes:

a fibrous structure which includes the above-described fiber; and an elastomeric polymer impregnated in the fibrous structure.

Another embodiment of the invention provides a dyed article, which includes the above-described fiber and a dye.

Another embodiment of the invention provides a process for producing a fiber, which includes melt spinning a composition that includes:

of at least one block copolymer, which includes:

at least one polymer block (A) that includes 50 to 100% by weight of olefinic monomer units, based on the total weight of the block copolymer; and at least one polymer block (B) that includes 0.1 to 100% by weight of (meth)acrylic monomer units, based on the total weight of the block copolymer;

to produce a fiber.

Another embodiment of the invention provides a composite fiber, which includes:

80 to 20% by weight of a polymer composition, based on the total weight of the fiber; and 20 to 80% by weight of a thermoplastic polymer, based on the total weight of the fiber;

wherein the polymer composition includes 2 to 95% by weight, based on the total weight of the polymer composition, of at least one block copolymer, which includes:

at least one polymer block (A) that includes 50 to 100% by weight of olefinic monomer units, based on the total weight of the block copolymer; and at least one polymer block (B) that includes 0.1 to 100% by weight of (meth)acrylic monomer units, based on the total weight of the block copolymer.

Another embodiment of the invention provides a fibrous structure, which includes the above-described composite fiber.

Another embodiment of the invention provides a nonwoven fabric, which includes the above-described composite fiber.

Another embodiment of the invention provides a dyed article, which includes the above-described composite fiber and a dye.

DESCRIPTION OF THE PREFERRED EMBODIMENTS

Various other objects, features and attendant advantages of the present invention will be more fully appreciated as the same becomes better understood from the following detailed description of the preferred embodiments of the invention.

The invention preferably relates to a fiber which includes 2 to 95% by weight of a block copolymer made from at least one polymer block (A) that includes 50 to 100% by weight of olefinic monomer units and at least one polymer block (B) that includes 0.1 to 100% by weight of (meth)acrylic monomer units. The invention also preferably relates to a composite fiber resulting from composite spinning of a composition that includes the above block copolymer and another thermoplastic polymer in a ratio of 20–80% by weight to 80–20% by weight. Other preferable embodiments of the invention include various fibrous structures and leather-like sheet materials, which include such a fiber as a constituent.

The block copolymer constituting at least part of the fiber of the invention is constituted of the polymer block (A) and polymer block (B) mentioned hereinbelow and preferably includes, for example, A-B type diblock copolymers, A-B-A type triblock copolymers and B-A-B type triblock copolymers. Among them, A-B type diblock copolymers are preferred.

In the present invention, it is important to use the block copolymer which includes the polymer block (A) and polymer block (B), as mentioned above. When a random copolymer or graft copolymer of an olefinic monomer and a (meth)acrylic monomer, for instance, is used instead of the block copolymer in accordance with the invention, the dyeability against disperse dyes may not be satisfactorily improved, or only products that have poor color fastness will be obtained.

The polymer block (A) constituting the block copolymer according to the invention contains 50 to 100% by weight, preferably 70 to 100% by weight, more preferably 80 to 100% by weight, based on the whole structural units, of olefinic monomer units. These ranges include all values and subranges therebetween, including 52, 54, 57, 63, 68, 72, 75, 78, 82, 86, 88, 93 and 95%. When this content is less than 50% by weight, the lightweight properties and other characteristics intrinsic in polyolefins will be lost and the effects described herein cannot be produced. Preferable olefinic monomer units include, among others, units derived from aliphatic or alicyclic hydrocarbon compounds having a polymerizable double bond, such as ethylene, propylene, 1-butene, 2-methyl-1-butene, 3-methyl-1-butene, 2-butene, isobutylene, butadiene. isoprene, pentene, 4-methyl-1-pentene, 1-hexene, 1-octene, 1-decene, 1-octadecene, vinylcyclohexane, cyclopentadiene and β-pinene. Among them, one or two or more may be used. Preferred among these are units derived from ethylene, propylene, isobutylene and isoprene. More preferably, in the case of units derived from conjugated dienes, the remaining unsaturated bond may be hydrogenated.

The polymer block (A) may preferably contain, according to need, 0 to 50% by weight, more preferably 5 to 30% by weight, and more particularly preferably 10 to 20% by weight, of vinyl monomer units copolymerizable with the olefinic monomer mentioned above. These ranges include all values and subranges therebetween, including 1, 2, 4, 8, 12, 14, 22, 32, 38, 43 and 48%. Preferably, the vinyl monomer contained in block (A) improves the compatibility of the block copolymer with another polymer. Preferable vinyl monomer units copolymerizable with the olefinic monomer include, among others, units derived from styrenic monomers, such as styrene, p-styrenesulfonic acid and the sodium salt and potassium salt thereof; (meth)acrylonitrile; vinyl esters such as vinyl acetate and vinyl pivalate; (meth) acrylic acid and esters thereof, such as (meth)acrylic acid, methyl (meth)acrylate, ethyl (meth)acrylate, butyl (meth) acrylate, dodecyl, (meth)acrylate, 2-ethylhexyl (meth) acrylate and 2-hydroxyethyl (meth) acrylate; (meth) acrylamide; N-vinylpyrrolidone; N-vinylacetamide, etc. Among these, one or two or more may be used. More preferred include units derived from methyl acrylate, methyl methacrylate, styrene and acrylonitrile.

The polymer block (B) constituting the block copolymer of the invention contains 0.1 to 100% by weight, relative to the whole constituent units (or total weight of the polymer block (B)), of (meth)acrylic monomer units. When the content of the (meth)acrylic monomer units is less than 0.1% by weight, the dyeability characteristic against disperse dyes, which is the effect of the invention, may not be fully produced in some instances. Therefore, the content of the (meth)acrylic monomer units is preferably 55 to 99% by weight, more preferably 70 to 97% by weight, still more preferably 90 to 95% by weight. These ranges include all values and subranges therebetween, including 0.5, 2, 3, 4, 5, 6, 7, 8, 15, 20, 25, 35, 45, 56, 57, 58, 59, 62, 85 and 91%. The (meth)acrylic monomer units are preferably units derived from (meth)acrylic acid or esters thereof, more preferably including, among others, units derived from such monomers as (meth)acrylic acid, methyl (meth)acrylate, ethyl (meth)acrylate, propyl (meth)acrylate, butyl (meth) acrylate, pentyl (meth)acrylate, hexyl (meth)acrylate, cyclohexyl (meth)acrylate, octyl (meth)acrylate, nonyl (meth) acrylate, octadecyl (meth)acrylate, dodecyl (meth)acrylate, 2-ethylhexyl (meth)acrylate, hydroxyethyl (meth)acrylate and glycidyl (meth)acrylate. These monomers may be used singly or two or more of them may be used in admixture.

Methyl methacrylate and ethyl methacrylate give relatively high glass transition points and, when the product are dyed, contribute to increased color fastness, including washing fastness, color fastness to wet rubbing, etc., and hence are preferred.

In cases where the fiber of the invention is produced by mixed spinning or composite spinning of the block copolymer and a polymer having low compatibility therewith, such as a polyester or polyamide, the interfaces between both polymers tend to undergo peeling and, therefore, an epoxy-containing one, such as glycidyl (meth)acrylate, is especially preferred.

The polymer block (B) may contain not more than 99.9% by weight, preferably not more than 45% by weight, more preferably not more than 30% by weight, still more preferably not more than 10% by weight, relative to the whole structural units, of vinyl monomer units copolymerizable with the (meth)acrylic monomer, according to need. These ranges include all values and subranges therebetween, including 98, 97, 95, 85, 65, 45, 42, 35, 29, 25, 15, 12, 8, 7, and 5%. Preferable vinyl monomer units copolymerizable with the (meth)acrylic monomer include, among others, units derived from styrenic monomers such as styrene, p-styrenesulfonic acid and the sodium salt and potassium salt thereof, (meth)acrylonitriles; vinyl esters such as vinyl acetate and vinyl pivalate; (meth)acrylamide; N-vinyl-2-pyrrolidone; N-vinylacetamide, etc. One or two or more of these may be used. By copolymerizing these, the hardness and moisture absorption of the block copolymer can be adjusted or modified. When amide linkage-containing vinyl monomer units, such as (meth)acrylamide or N-vinylacetamide units, are used, dyeing with acid dyes or metal-containing dyes becomes possible and, thus, dyeing together with polyamides becomes possible in one and the same bath.

The polymer block (A) preferably has a number average molecular weight of 1,000 to 100,000, more preferably 2,500 to 50,000, more particularly preferably 5,000 to 40,000, and most preferably 7,000 to 30,000. These ranges include all values and subranges therebetween, including 1,200, 1,500, 10,000, 15,000, 25,000, 45,000, and 90,000. The polymer block (B) preferably has a number average molecular weight of 1,000 to 100,000, more preferably 2,500 to 50,000, more particularly preferably 5,000 to 40,000, and most preferably 7,000 to 30,000. These ranges include all values and subranges therebetween, including 1,200, 1,500, 10,000, 15,000, 25,000, 45,000, and 90,000. The block copolymer as a whole preferably has a number average molecular weight of 2,000 to 200,000, more preferably 5,000 to 100,000, more particularly preferably 7,000 to 75,000, and most preferably 10,000 to 50,000. These ranges include all values and subranges therebetween, including 3,200, 4,500, 12,000, 45,000, 85,000, 105,000, and 175,000. When the block (A) and block (B) each has a number average molecular weight less than 1,000, the fiber strength may decrease and, even when a value higher than 100,000 is desired, it is difficult to obtain the desired fiber, since the block polymerization for that purpose is difficult to conduct. The "number average molecular weight" so referred to herein means the value determined from a standard polystyrene-based working curve using the gel permeation chromatography (GPC) technique.

The ratio between the polymer block (A) and polymer block (B) in the block copolymer is not particularly limited and it may vary depending on the contents of olefinic monomer units and (meth)acrylic monomer units in the respective blocks. When, however, the content of olefinic monomer units in the block copolymer is too low, the lightweight, strength, chemical resistance and like properties may become poor in some instances and, when the content of (meth)acrylic monomer units is excessively small, the dyeability improving effect may not be produced to a satisfactory extent in certain instances. The ratio (by weight) of polymer block (A): polymer block (B) is therefore preferably 10-90:90-10, more preferably 20-80:80-20, more particularly preferably 30-70:70-30, and most preferably 40-60:60-40. These ranges include all values and subranges therebetween, including 12, 14, 18, 24, 36, 44, 52, 58, 64, 69, 72, 76, 81, 85 and 88 for either of A or B, and the remainder to 100 for B or A as the case may be.

The method of producing the block copolymer is not particularly limited. A preferable method of producing the block copolymer includes radical-polymerizing a monomer component(s) of polymer block (B) in the presence of a mercapto-terminated olefinic polymer block (A), for instance, since the block copolymer having a desired number average molecular weight and a desired molecular weight distribution can be produced expediently and efficiently.

The mercapto-terminated olefinic polymer block (A) can be synthesized by various preferred methods, for example by a method which includes adding thioacetic acid, thiobenzoic acid, thiopropionic acid, thiobutyric acid or thiovaleric acid to a polyolefin resin having a terminal double bond and then treating the product with an acid or alkali, or by a method which includes using ethylene sulfide or the like as a terminator in anionic polymerization of an olefin(s).

The fiber of the invention must contain 2 to 95% by weight of the above block copolymer. When the content of the block copolymer is less than 2% by weight, the composition containing the same together with another thermoplastic polymer cannot have both the characteristic features of the invention, namely lightweight property and sufficient dyeability (including percentage exhaustion, color development and color fastness), simultaneously. When the content of the block copolymer is in excess of 95% by weight, the spinnability tends to decrease and it is difficult to obtain a fiber having a practical strength.

Preferably, the fiber of the invention contains 5 to 90% by weight of the above-block copolymer; more preferably 10 to 80%, more particularly preferably 20 to 70%, and most preferably 30 to 60%. These ranges include values and subranges therebetween, including 6, 7, 8, 12, 14, 18, 25, 25, 35, 45, 55, 65, 75, 85 and 93%.

Preferably, the fiber of the invention also contains, in addition to the block copolymer, a thermoplastic polymer. Preferably, the thermoplastic polymer has a melting point of not higher than 270° C., more preferably not higher than 260° C., more particularly preferably not higher than 250° C., and most preferably not higher than 240° C. These ranges include all values and subranges therebetween, including 265, 255, 245, 235, 225, 215, 210, and 205° C. Preferably, the block copolymer and the thermoplastic polymer may be subjected to mixed spinning or composite spinning. Preferably, the thermoplastic polymer is at least one member selected from among aromatic polyesters and copolymers thereof, such as polyethylene terephthalate, polytrimethylene terephthalate, polybutylene terephthalate and polyhexamethylene terephthalate, aliphatic polyesters and copolymers thereof, such as polylactic acid, polyethylene succinate, polybutylene succinate, polybutylene succinate adipate, polyhydroxybutyrate-polyhydroxyvalerate copolymer and polycaprolactone, aliphatic polyamides and copolymers thereof, such as nylon 6, nylon 66, nylon 10, nylon 12 and nylon 6–12, polyolefins and copolymers thereof, such as polypropylene, polyethylene, polybutene and polymethylpentene, thermoplastic polyvinyl alcohol, modified polyvinyl alcohol containing 25 to 70 mole percent of ethylene units, and elastomers of the polystyrene type, polydiene type, chlorinated type, polyolefin type, polyester type, polyurethane type or polyamide type. Mixtures are possible.

Preferred from the viewpoint of ease of mixed spinning or composite spinning with the block copolymer are polybutylene terephthalate, ethylene terephthalate copolymers, polylactic acid, polypropylene, thermoplastic polyvinyl alcohol and modified polyvinyl alcohol containing 25 to 70 mole percent of ethylene units.

Preferably, in the practice of the invention, one or more of stabilizers such as copper compounds, colorants, ultraviolet absorbers, light stabilizers, antioxidants, antistatic agents, flame retardants, plasticizers, lubricants and crystallization retarders may be added as necessary in the polymerization reaction step or in a subsequent step or steps each within limits within which the object or effects of the invention will not be adversely affected. In particular, the addition, as a heat stabilizer, of an organic stabilizer, such as a hindered phenol, a copper halide compound, such as copper iodide or an alkali metal halide compound, such as potassium iodide is preferred since the stability in melting and retention behavior in the step of fiber production is improved thereby.

Preferably, fine particles having an average particle size of not less than 0.01 $\mu$m but not more than 5 $\mu$m may be added in an amount of not less than 0.05% by weight but not more than 10% by weight in the polymerization reaction step or in a subsequent step. More preferably, the average particle size is 0.05 to 4.5 $\mu$m, more particularly preferably 0.1 to 4 $\mu$m and most preferably 1 to 3 $\mu$m. These ranges include all values and subranges therebetween, including 0.015, 0.02, 0.75, 1.1, 2, 3.5, 4.1, 4.6, and 4.7 $\mu$m. More preferably, the amount is 0.08% to 9% by weight, based on the total weight of the fiber, more particularly preferably 0.1 to 8% by weight, and most preferably 1 to 7% by weight. These ranges include all values and subranges therebetween, including 2, 2.3, 3, 3.4, 4, 4.5, 5 and 6% by weight. The fine particles are not particularly limited. Silica, alumina, titanium oxide, calcium carbonate, barium sulfate and like inert fine particles are preferred, and these may be used singly or two or more species may be used combinedly. Particularly preferred are inorganic fine particles having an average particle size of not less than 0.02 $\mu$m but not more than 1 $\mu$m; they improve the spinnability and drawability.

The fiber of the invention is a fiber containing such a block copolymer as mentioned above as at least one component and is preferably a composite spun fiber or mixed spun fiber, for instance. In producing the composite fiber, the composite sectional geometry is not particularly restricted but may preferably be selected from among the core-sheath, sea-island, side-by-side, multi-layer lamination and radiant lamination types and combinations of these.

In the case of a composite spun fiber, the ratio between the polymer composition containing the block copolymer and other thermoplastic polymer is preferably 80:20 to 20:80 percent by weight, more preferably 30-70:70-30, more particularly preferably 40-60:60-40, and most preferably 50:50. These ranges include all values and subranges therebetween, including 24, 36, 44, 52, 58, 64, 69, 72 and 76 for either of the block copolymer and the thermoplastic polymer, and the remainder to 100 for the thermoplastic polymer of the block copolymer as the case may be. If the ratio of the polymer composition containing the block copolymer is less than 20% by weight, the obtained composite fiber has poor dyeability in some instances. While the ratio of the polymer composition containing the block copolymer is more than 80% by weight, the spinnability of composite fiber deteriorates in some instances.

The fiber of the invention can be produced by using any melt spinning apparatus known in the art in mixed spinning or in composite spinning. Thus, in mixed spinning, the block copolymer and the other thermoplastic polymer are melt-kneaded and the molten polymer flow is led to a spinning head, metered by means of a gear pump and discharged through a spinning nozzle and the filament discharged is taken up, whereby the desired filament is obtained. In the case of composite spinning, the block copolymer and the other thermoplastic polymer are melt-kneaded through separate extruders, followed by discharging through one and the same spinning nozzle. A mixture prepared in advance from the block copolymer and a plurality of polymers may be used as one of the composite-forming components.

As for the sectional geometry of the fiber, not only the solid circular section but also various shapes such as hollow (inclusive of multihollow), C-shaped, three-lobe, T-shaped, four-lobe, five-lobe, six-lobe, seven-lobe, eight-lobe, other multi-lobe and cruciform sections are possible.

The filament discharged from the spinning nozzle is taken up at a high speed without drawing or stretched as necessary. The drawing is carried out at a draw ratio of breaking elongation (HDmax)×0.55 to 0.9 at a temperature above the glass transition point.

At a draw ratio less than HDmax×0.55, any fiber having sufficient strength cannot be obtained stably. At a draw ratio exceeding HDmax×0.9, the filament tends to break. This range includes all values and subranges therebetween, including (HDmax×) 0.6, 0.65, 0.7, 0.75, 0.8 and 0.85. There are two cases of drawing, namely the filament discharged from the spinning nozzle is once taken up and drawn thereafter or the filament is drawn directly after spinning. Either mode may be employed in the practice of the invention. The drawing is preferably carried out in the manner of hot drawing, such as hot air drawing, hot plate, hot roller drawing or water bath drawing.

The fiber of the invention obtained in the above manner can be made into a fibrous structure, such as a yarn-like product, woven fabric, knit fabric or nonwoven fabric, either as such or in combination with another or other fibers. The fiber of the invention may be used in a short fiber form or in a filament form, and can be produced with a wide range of monofilament fineness, from ultrafine fibers to monofilament, according to the intended use thereof. The fineness is not restricted but the fiber can be utilized as a fiber of about 0.0001 dtex to 200 dtex, for instance. This range includes all values and subranges therebetween, including 0.001, 0.01, 0.1, 1, 10, 20, 40, 80, 100 and 160 dtex.

When the fibrous structure is a nonwoven fabric, fibers obtained by the above-mentioned method of fiber production may be made into a card web or filaments after melt spinning may be directly made into a nonwoven fabric by the spun bond or melt blown process, for instance.

The nonwoven fabric may be constituted of an olefinic fiber containing the block copolymer as at least one component thereof or some other fiber or fibers may be mixed therein or laid thereon.

The section of the fiber constituting the nonwoven fabric may be circular or any of various modified cross-sections or hollow.

The leather-like sheet material is preferably produced, for example, by the following combination of steps. It can be produced by performing, in sequence, the step of producing the fiber of the invention, the step of producing a cloth from the fiber, the step of temporary fixation of the cloth if necessary, the step of impregnating the cloth with an elastomeric polymer solution, the step of forming a dense foamed body of the elastomeric polymer by coagulation, and the step of dyeing with a disperse dye or the like if necessary. A three-dimensionally entangled nonwoven fabric is preferred as the cloth among others, since it gives those physical properties and feel resembling those of a natural leather.

The fiber may be a mixture of the block copolymer and another thermoplastic polymer(s) or a composite fiber or mixed spun fiber produced from a mixture of the block copolymer and another thermoplastic polymer(s) in combination with a further other thermoplastic polymer in the side-by-side, multilayer lamination or core-sheath manner or in an irregular manner. As for the cross-section of the fiber, the ordinary circular section as well as a flat, triangular, Y-shaped, X-shaped, C-shaped, L-shaped, W-shaped, other modified, or hollow section, or any other fiber section geometry may be employed according to need.

In the practice of the invention, the olefinic fiber species to be used in the above aspect of the invention, the block ratio, the mixing ratio, the fiber fineness and the fiber cross-section geometry can be appropriately selected. The fiber fineness is preferably not more than 3 dtex, more preferably not more than 2 dtex, still more preferably not more than 1.5 dtex. These ranges include all values and subranges therebetween, including 2.9, 2.7, 2.4, 2.2, 2.1, 1.9 and 1.8 dtex.

Preferably, in the practice of the invention, the main constituent of the fiber component constituting the leather-like sheet material preferably has a fineness of not more than 0.5 dtex, more preferably not more than 0.3 dtex, still more preferably not more than 0.1 dtex, which ranges include all values and subranges therebetween. By selecting a monofilament fineness of not more than 0.5 dtex, it is possible to attain a good suede-like appearance, softness and touch.

Although the fiber having such a fineness may be a fine fiber prepared in advance, it is preferred from the sheet formation step viewpoint that a fiber capable of generating ultrafine fibers, such as a extractable composite fiber or splittable composite fiber, be used to prepare a sheet, which is then to be subjected to extraction or splitting treatment to generate ultrafine fibers.

A sea-island type composite fiber is preferably used as the extractable fiber. The polymer to be used as the sea component is preferably a polymer showing a lower melt viscosity and a higher surface tension under the spinning conditions as compared with the block copolymer composition to be used according to the invention. Further, the polymer must differ in solubility or decomposability against a solvent or decomposing agent from the block copolymer composition to be used in the practice of the invention, namely it must be higher in solubility or decomposability than the block copolymer. Further, it is a polymer low in compatibility with the block copolymer. Thus, for example, it includes at least one polymer selected from among such polymers as copolyesters, polystyrene, and thermoplastic polyvinyl alcohol. Mixtures are possible.

For example, copolyesters can be readily extracted with a hot alkali, and polystyrene with toluene. Thermoplastic polyvinyl alcohol can be removed with hot water. A bundle of ultrafine fibers can be obtained by removing the sea component from this sea-island structure fiber by extraction of decomposition. In the cross-section of the sea-island structure fiber, the sea component may be divided into a plurality of sections by the island component. For instance, the fiber may be in a state of multilayer laminate or the island component thereof may have a core-sheath structure. The island component and the sea component may be endlessly continuous in the direction of fiber length, or in a discontinuous state.

Preferable as the splittable composite fiber are a fiber having a multilayer laminate structure and a fiber having a radially laminated structure. Such a fiber can be obtained by composite spinning or mixed spinning of two or more polymers (one of them being the block copolymer mentioned above) with poor mutual compatibility. The respective polymers may be endlessly continuous in the direction of fiber length or in a discontinuous state. This splittable composite fiber can be made into a bundle of ultrafine fibers by water jet treatment, crumpling or alkali treatment, for instance.

The nonwoven fabric forming the matrix fiber structure of the leather-like sheet material may be produced by making a card web using the fiber obtained by the method mentioned above, or by subjecting the filament after spinning directly to the spun bond process, for instance.

In making a card web, the fiber drawn is crimped and the resulting raw stock is opened on a card and submitted to a webber to give a web, the fibrous web obtained is layered to a desired weight and thickness and then subjected to entanglement treatment by a method known in the art, for example needle punching or high-pressure water jet entanglement, to give a nonwoven fabric. Alternatively, the staple or cut fibers are entangled with a knit or woven fabric by a water jet or by needling to give a cloth. The cross-section of the fiber constituting the nonwoven fabric may be circular or have any of various modified cross-sections or be hollow.

Preferably, a natural fiber, a cellulosic regenerated fiber and/or some other synthetic fiber may be used in admixture with the fiber containing the block copolymer according to the invention within limits within which neither dyeability nor lightweight will be impaired.

If necessary, the nonwoven fabric produced in the above manner may be subjected to temporary fixation treatment for mutual bonding of the fibers constituting the nonwoven fabric by providing the same with a polyvinyl alcohol-based paste or superficially melting the constituent fibers. By conducting this treatment, it is possible to prevent the nonwoven fabric from being destructed in the subsequent steps, such as the step of impregnating the same with an elastomeric polymer solution.

This nonwoven fabric is then impregnated with an elastomeric polymer solution, followed by drying by heating to thereby cause gelation or by immersion in a liquid phase containing a nonsolvent for the elastomeric polymer to thereby cause wet coagulation, to give a dense foamed sponge of the elastomeric polymer. The elastomeric polymer to be used for impregnation includes, among others, polyurethanes obtained by reacting at least one polymer diol selected from among polyester diols, polyether diols and polycarbonate diols, each having an average molecular weight of 500 to 3,000, at least one diisocyanate selected from among aromatic, alicyclic and aliphatic diisocyanates such as 4, 4'-diphenylmethanediisocyanate, isophoronediisocyanate and hexamethylene diisocyanate, and at least one low-molecular compound having two active hydrogen atoms such as ethylene glycol or isophoronediamine in an appropriate mole ratio, modifications of such polyurethanes and, further, such elastomeric polymers as polyester elastomers and hydrogenated styrene-isoprene block copolymers as well as acrylic resins. Polymer compositions prepared by mixing these may also be used. The above-mentioned polyurethanes are preferred, however, from the viewpoint of flexibility, elastic recovery, sponge forming ability and durability, among others.

The nonwoven fabric is impregnated with a polymer solution or dispersion prepared by dissolving or dispersing the polymer mentioned above in a solvent or a dispersion medium. The impregnated nonwoven fabric is treated with a nonsolvent for the resin for wet coagulation to give a sponge, or it is dried as such by heating for causing gelation to lye a sponge. A fibrous sheet containing the elastomeric resin is thus obtained. In the polymer solution/dispersion, one or more additives selected from among colorants, coagulation adjusting agents, antioxidants and dispersants may be incorporated when necessary. The proportion of the elastomeric polymer in the fibrous sheet after removal of the sea component is not less than 10% by weight, preferably within the range of 30–50% by weight, on the solids basis, and on the total weight of the impregnated fibrous sheet. This range includes all values and subranges therebetween, including 12, 16, 20, 25, 35 and 45% by weight. When the proportion of the elastomer is less than 10%, no dense elastomer sponge will be formed and ultrafine fibers after generation thereof may readily undergo dislocation.

The fibrous sheet impregnated with the elastomeric resin is treated, if necessary, for making the sheet-constituting fiber ultrafine. Thus, the fiber having a sea-island structure can be converted to ultrafine fibers by removing the sea component, while the splittable fiber can be converted to ultrafine fibers by splitting or peeling the fiber-constituting polymers at interfaces therebetween. The conversion of the fiber to ultrafine fibers may also be carried out before impregnation.

The leather-like sheet material of the invention can be given a suede-like appearance and feel by napping the surface of the sheet obtained in the above-mentioned manner. Buffing using a sandpaper, a needle cloth or the like can be employed as the method of napping. By forming a resin layer on the surface of the sheet obtained by the method mentioned above, it is also possible to produce a leather-like sheet material having a grain side.

According to the invention, it is now possible to obtain light-weight fibers dyeable with disperse dyes, for example, by mixing or compositing the block copolymer mentioned above with a thermoplastic polymer, such as polypropylene, which has so far been impossible to dye with disperse dyes, followed by spinning. Further, by mixing or compositing the block copolymer with a disperse dye-dyeable thermoplastic polymer, such as a polyester, followed by spinning, it is possible to render polyester fibers lightweight while retaining the good dyeability intrinsic the polyester.

In dyeing the fiber of the invention with a disperse dye, the method of dyeing polyesters with disperse dyes can be used. When a polyolefin constitutes the main component of the fiber, however, care should be paid to the setting temperatures for heat setting before and after dyeing. Namely, since the polyolefin having a melting point lower than polyethylene terephthalate is the chief material, the setting temperatures should preferably be set at levels lower than the case with polyesters when presetting and final setting are carried out.

Preferred dyes are those disperse dyes now in use for polyesters. The dyeing temperature can he selected according to the intended use. From the percent exhaustion, dimensional stability and fastness viewpoint, however, the range of 80° C. to 140° C. is preferred. This range includes all values and subranges therebetween, including 90, 100, 110, 115, 120, 125, 130 and 135° C.

Reduction and washing after dyeing is preferred since this treatment can remove, by decomposition, the disperse dye on the fiber surface, whereby the fastness is increased. The reduction/washing conditions may be the same as those for regular polyesters, and reduction and washing can be effected using a reducing agent such as hydrosulfite.

In cases where the fiber of the invention contains a polyamide, the dyeing is preferably carried out in stages, first with a disperse dye and then with an acid dye or metal-containing dye. Further when an amide bond-containing vinyl monomer units, such as derived from (meth)acrylamide or N-vinylacetamide, is used in the block copolymer to be used in producing the fiber of the invention, the fiber becomes dyeable with acid dyes or metal-containing dyes, hence can be dyed together with polyamides in one and the same bath. After-treatment with tannic acid following dyeing with an acid dye or metal-containing dye is preferred since the fastness is increased thereby.

The fiber of the invention, when dyed with a disperse dye, shows excellent color fastness, and the fiber can be rendered lightweight, the fiber can be utilized in various fields of application, such as clothing, daily necessities and industrial materials, where such performance characteristics are required, and in other various fields. For example, it can be used in such applications as binder fiber for papermaking, binder fiber for nonwoven fabric, staple for dry-process nonwoven fabric, staple for spinning, multifilament for woven or knitting fabric (such as textured yarn, combined yarn), woven fabric, knitting fabric, sewing thread, packaging material, diaper liner, paper diaper, sanitary items, incontinence pad, other health products, surgical gown, surgical tape, mask, sheet, bandage, gauze, sanitary cotton, first aid adhesive plaster base cloth, poultice base cloth, wound covering, other medical products, splicing tape, hot melt sheeting, interlining, sheet for plant culture, covering for agricultural use, root surrounding sheet, fishing line, cement reinforcement, rubber reinforcement, masking tape, cap, filters, cell separator, wiping cloth, abrasive cloth, towel, hand towel, puff for cosmetic use, cosmetic pack, apron, glove, table cloth, toilet seat cover, other various covers, wallpaper, toy, vehicle seat or sofa top, other interior items, jacket, blazer, other clothing items, shoe, bag, glove, accessory case, other miscellaneous goods, etc.

EXAMPLES

Having generally described this invention, a further understanding can be obtained by reference to certain specific examples which are provided herein for purposes of illustration only and are not intended to be limiting unless otherwise specified. In the examples, "part(s)" and "%" are on the weight basis, unless otherwise specified.

(Fiber Specific Gravity)

The balance method of JIS K 0061 was used.

(Fiber Strength and Elongation)

The method of JIS L 1013 was used.

(Percentage Exhaustion Determination)

The dye solution before or after dyeing was diluted with a mixed solvent composed of acetone and water (1/1 by volume) and the dilution was measured for absorbance and the percentage exhaustion was calculated as follows:

$$\text{Percentage exhaustion } (\%)=(D-C)/C)\times 100$$

where C: absorbance at the maximum absorption wavelength of the dye solution after dyeing;

D: absorbance at the maximum absorption wavelength of the dye solution before dyeing.

(K/S Measurement)

The spectral reflectance (R) was measured using a color analyzer (automatic spectrophotometer, model C-2000, product of Hitachi, Ltd.) and the K/S value was calculated according to the equation (Kubelka-Munk equation). The higher this value is, the higher the bathochromicity.

$$K/S=(1-R)^2/2R$$

(R being the reflectance at the maximum absorption wavelength on the visible reflectance curve for the sample).

(Light Fastness)

Evaluation was made according to JIS L 0842 using a lightfast carbon fade at a black temperature of 63° C.

(Color Fastness to Washing)

Evaluation was made according to JIS L 0844, Method A-2.

(Nonwoven Fabric Strength and Elongation)

Measurements were made according to JIS L 1085 "Method of testing nonwoven interlining".

Reference Example 1

Production of Block Copolymer (I) (Diblock Copolymer Consisting of Polypropylene Block-Polymethyl Methacrylate Block)

(1) Polypropylene (Mitsubishi Noblen MH8 (registered trademark) product of Mitsubishi Chemical) was fed to a twin-screw extruder and melt-kneaded at 420° C. to thereby produce polypropylene having a terminal double bond.

(2) A reaction vessel was charged with 100 weight parts of the double bond-terminated polypropylene obtained as mentioned above under (1), 1,000 weight parts of toluene and 30 weight parts of thio-S-acetic acid, the vessel inside was thoroughly purged with nitrogen and, then 10 weight parts of 2,2'-azobisisobutyronitrile was added. The reaction was allowed to proceed at 80° C. for 6 hours to give thioacetyl-terminated polypropylene.

(3) The thioacetyl-terminated polypropylene (60 weight parts) obtained as mentioned above under (2) was dissolved in a mixed solvent composed of 100 weight parts of toluene and 20 weight parts of n-butanol, 1 weight part of a 7% potassium hydroxide solution in n-butanol was added, and the reaction was allowed to proceed at the toluene refluxing temperature under nitrogen for 6 hours to give mercapto-terminated polypropylene.

(4) The mercapto-terminated polypropylene (50 weight parts) obtained as mentioned above under (3) was dissolved in 184 weight parts of toluene, 42 weight parts of methyl methacrylate was added thereto. 1,1'-Azobis(cyclohexane-1-carbonitrile) was added at 90° C. under nitrogen at a rate such that the rate of polymerization of methyl methacrylate amounted to about 10% per hour and, at the time point when the conversion arrived at 95%, the reaction was terminated. The solvent and unreacted monomer were removed from the reaction mixture obtained, whereby an A-B type diblock copolymer consisting of a polypropylene block and a polymethyl methacrylate block (hereinafter referred to as "block copolymer (I)") was obtained.

In the block copolymer (I) obtained, the polypropylene had a number average molecular weight of 13,000, the polymethyl methacrylate block had a number average molecular weight of 12,000 and the overall number average molecular weight was 25,000, with a molecular weight distribution of 2.5.

Reference Example 2

Production of Block Copolymer (II) (Block Copolymer Consisting of Polyethylene Block-Polymethyl Methacrylate Block)

(1) Polyethylene ("Hizex HD700F", product of Mitsui Petrochemical) was fed to a twin-screw extruder and melt-kneaded at 420° C. to thereby produce polyethylene having a terminal double bond.

(2) A reaction vessel was charged with 100 weight parts of the double bond-terminated polyethylene obtained as mentioned above under (1), 1,000 weight parts of toluene and 30 weight parts of thio-S-acetic acid, the vessel inside was thoroughly purged with nitrogen and, then, 10 weight parts of 2.2'-azobisisobutyronitrile was added. The reaction was allowed to proceed at 90° C. for 6 hours to give thioacetyl-terminated polyethylene.

(3) The thioacetyl-terminated polyethylene (60 weight parts) obtained as mentioned above under (2) was dissolved in a mixed solvent composed of 100 weight parts of toluene and 20 weight parts of n-butanol, 1 weight part of a 7% potassium hydroxide solution in n-butanol was added, and the reaction was allowed to proceed at the toluene refluxing temperature under nitrogen for 6 hours to give mercapto-terminated polyethylene.

(4) The mercapto-terminated polyethylene (50 weight parts) obtained as mentioned above under (3) was dissolved in 184 weight parts of toluene, 100 weight parts of methyl methacrylate was added thereto. 1,1'-Azobis(cyclohexane-1-carbonitrile) was added at 90° C. under nitrogen at a rate of such that the rate of polymerization of methyl methacrylate amounted to about 10% per hour and, at the time point when the conversion arrived at 95%, the reaction was terminated. The reaction mixture was cooled and then toluene was added to make the solid concentration 40%.

An A-B type diblock copolymer consisting of a polyethylene block (A) and a polymethyl methacrylate block (B) (hereinafter referred to as 'block copolymer (II)") was obtained. In the block copolymer (II) obtained, the polymer block (A) had a number average molecular weight of 8,200, the polymer block (B) has a number average molecular weight of 16,000, and the overall number average molecular weight was 24,200.

Reference Example 3

Production of Block Copolymer (III) (PP-b-MMA-GMA Block Copolymer)

The mercapto-terminated polypropylene (50 weight parts) obtained in Reference Example 1 was dissolved in 184 weight parts of toluene, 40 weight parts of methyl methacrylate and 10 weight parts of glycidyl methacrylate were added, and 1,1 '-azobis (cyclohexane-1-carbonitrile) was added at 90° C. under nitrogen at a rate such that the rate of polymerization of methyl methacrylate/glycidyl methacrylate amounted to about 10% per hour and, at the time point when the conversion arrived at 95%, the polymerization was terminated. The solvent and unreacted monomers were removed from the reaction mixture obtained, whereby an A-B type diblock copolymer consisting of a polypropylene block and a polymethyl methacrylate/glycidyl methacrylate block (hereinafter referred to as "block copolymer (III)") was obtained.

In the block copolymer (III) obtained, the polypropylene had a number average molecular weight of 13,000, the polymethyl methacrylate/glycidyl methacrylate block had a number average molecular weight of 10,000, and the overall number average molecular weight was 23,000, with a molecular weight distribution of 2.6.

Reference Example 4

Production of Block Copolymer (IV) (PP-b-MMA-St Block Copolymer)

The mercapto-terminated polypropylene (50 weight parts) obtained in Reference Example 1 was dissolved in 184 weight parts of toluene, 5 weight parts of methyl methacrylate and 45 weight parts of styrene were added, and 1,'-azobis(cyclohexane-1-carbonitrile) was added at 90° C. under nitrogen at a rate such that the rate of polymerization of methyl methacrylate/styrene amounted to about 10% per hour and, at the time point when the conversion arrived at 95%, the reaction was terminated. The solvent and unreacted monomers were removed from the reaction mixture obtained, whereby an A-B type diblock copolymer consisting of a polypropylene block and a polymethyl methacrylate/styrene block (hereinafter referred to as "block copolymer (IV)") was obtained.

In the block copolymer (IV) obtained, the polypropylene had a number average molecular weight of 13,000, the polymethyl methacrylate/styrene block had a number average molecular weight of 9,500, and the overall number average molecular weight was 22,500, with a molecular weight distribution of 2.9.

Example 1

The block copolymer (I) obtained in Reference Example 1 and polypropylene (SA2D, product of Nippon Polychem)

were blended together in a ratio of 1:9 and, after melt kneading in an extruder, the polymer flow was led to a spinning head and discharged through a nozzle having a circular section at 250° C. and the filament was taken up at a speed of 1,000 m/min. The spun filament obtained was subjected to roller plate drawing at a roller temperature of 100° C., a plate temperature of 140° C. and a draw ratio of 3.5, to give a drawn filament with 83 dtex/24 f. This was further made into a knitting fabric using a cylindrical knitting machine, and the fabric was dyed using a disperse dye. The dyed knitting fabric had a deep and dark color and was excellent in light and the strength was also excellent. The fiber physical properties and dyeability are shown in Table 1.

1) Dyeing Conditions

Temperature×time=130° C.×40 min

Dye: Dianix Navy Blue SPH (Dystar) 5% omf

Dispersant: Disper TL (MEISEI CHEMICAL WORKS, LTD) 1 g/1

Acetic acid (50%): 1 cc/1

Bath ratio=1:50

2) Reduction/Washing Conditions

80° C.×20 min

Hydrosulfite 1 g/1

Sodium hydroxide 1 g/1

Amiladin D (DAI-ICHI KOGYO SEIYAKU CO., LTD) 1 g/l.

used in lieu of the block copolymer (I). The spinnability was poor and the filament could be taken up only for a very short time. The spun filament obtained in a small amount was drawn and made into a knitting fabric, which was then dyed with a disperse dye. The knitting fabric had been dyed slightly but to an unsatisfactory extent, the fastness was poor and the strength was low. The fiber physical properties and dyeability are shown in Table 1.

Reference Example 5

Polyethylene terephthalate (limiting viscosity 0.67) was melt-kneaded in an extruder and the polymer flow was then lead to a spinning head and discharged through a nozzle at 290° C. and the filament was taken up at a speed of 1,000 m/min. The spun filament obtained was subjected to roller plate drawing at a roller temperature of 80° C., a plate temperature of 160° C. and a draw ratio of 3.5, to give a drawn filament with 83 dtex/24 f. This was further made into a knitting fabric using a cylindrical knitting machine, and the fabric was dyed using a disperse dye. The dyed knitting fabric had a deep and dark color and was excellent in color fastness as well. However, the fiber specific gravity was high and a somewhat hard feel and touch. The fiber physical properties and dyeability are shown in Table 1.

Example 4

A fiber was produced and dyed in the same manner as in Example 1 except that the block copolymer (IV) was used in lieu of the block copolymer (I) and mixing ratio between the block copolymer (IV) and polypropylene was 15:85. The dyed knitting fabric attained the practical level. The fiber physical properties and dyeability are shown in Table 1.

TABLE 1

| | Sp. gr. (g/cm$^3$) | Fineness (dtex) | Strength (CN/dtex) | Elongation (%) | Exhaustion (%) | K/S | Light fastness (class) | Washing fastness (class) Cotton | Nylon | Residual solution |
|---|---|---|---|---|---|---|---|---|---|---|
| Ex. 1 | 0.92 | 83 | 4.5 | 39 | 90.4 | 25 | 3 | 5 | 5 | 3–4 |
| Ex. 2 | 0.91 | 83 | 4.8 | 37 | 87.6 | 23 | 3 | 5 | 5 | 4 |
| Ex. 3 | 0.98 | 83 | 4.1 | 41 | 96.6 | 28 | 3 | 3 | 3 | 3 |
| Compar. Ex. 1 | 0.91 | 83 | 5.2 | 35 | 46.7 | 9 | — | — | — | — |
| Compar. Ex. 2 | 0.92 | 83 | 1.8 | 18 | 53.4 | 13 | 2 | 1–2 | 1–2 | 1–2 |
| Ref. Ex. 5 | 1.38 | 83 | 4.6 | 28 | 97.5 | 30 | 4 | 5 | 5 | 5 |
| Ex. 4 | 0.92 | 83 | 4.2 | 31 | 89.5 | 22 | 3 | 4 | 4 | 3 |
| Ex. 5 | 1.12 | 83 | 3.5 | 25 | 91.5 | 21 | 3 | 3 | 3 | 3 |
| Ex. 6 | 1.23 | 83 | 4.0 | 38 | 95.5 | 26 | 3–4 | 4–5 | 4–5 | 4 |
| Ex. 7 | 1.17 | 83 | 4.2 | 32 | 96.1 | 27 | 4 | 4–5 | 4–5 | 4–5 |
| Ex. 8 | 1.04 | 83 | 4.9 | 43 | 92.2 | 23 | 3 | 4 | 4 | 4 |

Comparative Example 1 and Examples 2 and 3

Fibers were produced and dyed in the same manner as in Example 1 except that the mixing ratio between the block copolymer (I) and polypropylene was 0:100 (Comparative Example 1), 5:95 (Example 2) or 50:50 (Example 3). The fiber of Comparative Example 1 in which the mixing ratio was 0:100 was low in percentage exhaustion, appeared only contaminated and could hardly be said to have been dyed. When the mixing ratio was 5:95 or 5:5, fibers dyed to a practical level were obtained. The fiber physical properties and dyeability data are shown in Table 1.

Comparative Example 2

An attempt was to produce a fiber in the same manner as in Example 1 except that an ethylene-ethyl acrylate copolymer ("Rexloston EEA" A-6170 (ethyl acrylate content 17%, MFR=20), product of Nippon Petrochemicals Co., Ltd.) was Example 5

A fiber was produced in the same manner as in Example 1 except that the block copolymer (II) of Reference Example 2 and modified polyvinyl alcohol having an ethylene unit content of 44 mole percent (EVAL (registered trademark) E105, Kuraray Co., Ltd.) were used and spun at 250° C. The fiber obtained was made into a knitting fabric, crosslinked under the conditions given below and then dyed with a disperse dye. The fiber after dyeing showed a deep color tone and a luster. The fastness was also good. The fiber physical properties and dyeability are shown in Table 1.

1) Crosslinking Conditions

Temperature×time: 110° C.×40 min

Treatment solution: 1,1,9,9-Bisethylenedioxynonane 5 g/l

Lavasion (Matsumoto Yushi-Seiyaku Co., Ltd) 05. g/l

Maleic acid

Bath ratio: 1:50

2) Dyeing Conditions

Temperature×time: 130° C.×40 min

Dye: Dianix Navy Blue SPH (Dystar) 5% omf

Dispersant: Disper TL (MEISEI CHEMICAL WORKS, LTD) 1 g/l

Acetic acid (50%): 1 cc/l

Bath ratio: 1:50

3) Reduction/Washing Conditions

80° C.×20 min

Hydrosulfite 1 g/l

Sodium hydroxide 1 g/l

Amiladin D (DAI-ICHI KOGYO SEIYAKU CO., LTD) 1 g/l.

Example 6

The block copolymer (I) obtained in Reference Example 1 and polypropylene (SA2D, Nippon Polychem) were melt-kneaded in a weight ratio of 1:9 in an extruder and, in another extruder, polyethylene terephthalate (limiting viscosity 0.67) was melt-kneaded, and both the melts were separately fed, in a weight ratio of 2:1, to a spinning head for forming a multilayer laminate type composite containing 6 layers of polyethylene terephthalate and 5 layers of the block copolymer (I)-polypropylene mixture and together melt-spun at a spinning temperature of 285° C. through a 24-hole circular-hole nozzle having a metering portion diameter of 0.25 mm ϕ, a land length of 0.5 mm and having a trumpet-like widening nozzle outlet with an outlet diameter of 0.5 mm ϕ.

A cooling air blower of the horizontal blow type with a length of 1.0 m was disposed directly below the spinneret, and the composite filaments spun out from the spinneret was immediately introduced into the cooling air blower. Cooling air adjusted to a temperature of 25° C. and a humidity of 65% RH was blown to the spun filaments at a rate of 0.5 m/sec to cool the filaments to 50° C. or below (the temperature of the filaments at the exit of the cooling air blower=40° C.).

The composite filaments cooled to 50° C. or below in the above manner were introduced into a tube heater (inside wall temperature 180° C.) with a length of 1.0 m and an inside diameter of 30 mm as disposed directly below the spinneret at a distance of 1.6 m and drawn within the tube heater. The filaments coming out of the tube heater were provided with an oil by the guide oiling technique and then taken up via a pair of (two) take-up rollers at a take-up speed of 4,000 m/min to give a drawn 83 dtex/24 filaments composite fiber. The spinning step proceeded satisfactorily without any problem.

The composite fiber obtained was made into a cylindrical knitting fabric and dyed with a disperse dye in the same manner as in Example 1. It could be confirmed that, like polyethylene terephthalate, the block copolymer-containing polypropylene has a sufficient level of dyeability and a splitted fiber can be obtained without dyeing irregularities. The fiber physical properties and dyeability are shown in Table 1.

Example 7

A mixture of the block copolymer (III) of Reference Example 3 and polypropylene (weight ratio 3:7), and polyethylene terephthalate were melt-kneaded in separate extruders and the melts were led, as the core component and sheath component, respectively, in a weight ratio of 1:1, to a spinning head and discharged through a 24-hole nozzle with an aperture diameter of 0.4 mm, and the filaments were taken up at a speed of 1,000 m/min. A knitting fabric was produced from the fiber obtained and dyed. The fiber obtained was equivalent in color development to regular polyester fibers and lighter then regular polyesters. The fiber physical properties and dyeability are shown in Table 1.

Example 8

Spinning, drawing, fiber finishing and knitting fabric manufacture were carried out in the same manner as in Example 7 except that nylon 6 (UBE NYLON 1011, Ube Industries, Ltd.) was used as the sheath component in lieu of polyethylene terephthalate.

The knitting fabric obtained was first dyed with a disperse dye and subjected to reduction and washing in the same manner as in Example 1 and then dyed with an acid dye under the conditions given below. The dyed knitting fabric showed a deep and dark color with good fastness. It has a low fiber specific gravity and was lightweight and excellent in strength as well. The fiber physical properties and dyeability are shown in Table 1.

1) Dyeing Conditions

Temperature×time=100° C.×40 min

Dye: Lanyl Navy Blue TW (Sumitomo Chemical) 3% omf

Ammonium sulfate 5% omf

Acetic acid 1% omf

Bath ratio 1:50

2) Soaping

70° C.×20 min

Amiladin D (DAI-ICHI KOGYO SEIYAKU CO., LTD) 1 g/l

3) After-Treatment

70° C.×20min

Nylox 1500 (Ipposha Co., Ltd.) 1 g/l.

Example 9

A 83 dtex/24 f fiber having a cross-shaped section was obtained by performing spinning and drawing in the same manner as in Example 1 except that a nozzle for cross-shaped section spinning was used as the spinning nozzle. The fiber obtained was made into a cylindrical knitting fabric and dyed in the same manner as in Example 1. The fabric had a deep color, was lightweight and looked bulky.

Example 10

A hollow 83 dtex/24 f fiber having a hollowness of 30% was obtained by performing spinning and drawing in the same manner as in Example 1 except that a nozzle for hollow circular section spinning was used as the spinning nozzle. The fiber obtained was made into a cylindrical knitting fabric and dyed in the same manner as in Example 1. The fabric had a deep color, was lightweight and looked bulky.

Example 11

The copolymer (10% by weight) of Reference Example 1 was dry-blended with 90% by weight of commercial polypropylene (SA2D, Nippon Polychem) and the blend was melt-kneaded in an extruder and the molten polymer was fed to a spinning head so that it might serve as a sea component. In another extruder, ethylene (10 mole percent)-modified thermoplastic polyvinyl alcohol was melted and led to the spinning head so that it might serve as an island component. Thus, a 16-island composite filament (sea component/island component weight ratio 1:1) was melt-spun at a head temperature of 250° C. and a rate of spinning of 800 m/min. This was drawn in the same manner as in Example 1 to give a 83 dtex/24 f sea-island fiber. The fiber obtained was made into a cylindrical knitting fabric and dyed in the same manner as in Example 1. The dyed fabric had a deep color and, after extraction of the sea component, it was very light, namely 41 dtex/24 f.

Example 12

The filament obtained in Example 1 was crimped and cut to 51 mm to give a raw stock. This raw stock was carded and made into a web with a basis weight of 50 g/m$^2$ and the web was further embossed at 150° C. using a roll having a pattern of woven fabric and an pressing area of 20%. The short fiber nonwoven fabric obtained had a specific gravity of 0.91 g/cc and was thus light and bulky. Further it was dyed with a disperse dye in the same manner as in Example 1, whereby a nonwoven fabric excellent in color development was obtained.

Example 13

The block copolymer (I) obtained in Reference Example 1 was mixed with polypropylene (SA2D, Nippon Polychem) in a ratio of 1:9 and the blend was melt-kneaded in an extruder. The polymer flow was led to a spinning head and discharged through a 24-hole spinneret with an aperture diameter of 0.4 mm at 250° C. and the spun filaments were introduced, while being cooled with cooling air at 20° C., into a cylindrical suction/jet blast apparatus and stretched and rendered thin by taking up at a substantial rate of 3,000 m/min, the opened filament group was collected and piled up on a traveling collector conveyor apparatus to form a fiber web. This web was passed between an embossing roll and a flat roll, heated at 150° C., at a line pressure of 20 kg/cm, for partial thermal adhesion of embossed portions. A long fiber nonwoven fabric with a filament fineness of 1.5 dtex and a basis weight of 35 g/m$^2$ was obtained. Its specific weight was 0.91 g/cc and thus it was light and had a flexible feeling. The long fiber nonwoven fabric obtained was dyed with a disperse dye in the same manner as in Example 1, whereby a nonwoven fabric excellent in color development and suited for use as a interlining cloth or the like was obtained.

Example 14

The block copolymer (I) obtained in Reference Example 1 was dry-blended with commercial polypropylene (SA2D, Nippon Polychem) in a ratio of 10%:90% by weight and the blend was melt-kneaded in an extruder and the polymer flow was led to a spinning head as an island component and, in another extruder, modified polyethylene terephthalate (limiting viscosity 0.63) produced by copolymerization with 5 mole % of sulfoisophthalic acid and 40 wt % of polyethylene glycol was melted and this modified polyethylene terephthalate was led to the spinning head as a sea component. Thus, a 16-island composite fiber (sea component/island component weight ratio 1:1) was obtained by melt spinning at a head temperature of 290° C. and a spinning speed of 800 m/min. This was drawn 4 times in warm water at 90° C., crimped and dried and then cut to 51 mm. The resulting staple fibers were made into a web by the cross lapping method. The web was then subjected to needle punching at 1,050 P/cm$^2$ from both sides. This needle-punched nonwoven fabric was impregnated with an aqueous solution of polyvinyl alcohol (hereinafter, PVA) and pressed by means of a calender roll to give a surface-smooth entangled nonwoven fabric. This entangled nonwoven fabric was impregnated with a solution of a polyurethane mainly composed of a tetramethylene ether-based polyurethane with a solid content of 13% in dimethylformamide (hereinafter, DME) and then immersed in a DMF/water mixture for wet coagulation. Thereafter, the sea component in the composite-spun fiber was removed by dissolution in a hot alkali (40 g/liter NaOH, 80° C.) for revealing ultrafine fibers, whereby a fibrous sheet was obtained. The average fiber diameter of the ultrafine fibers (as determined by dividing the total sectional area of ultrafine fibers occurring in one fiber bundle by the number of fibers) was 3.5 $\mu$m. The weight proportion of the polyurethane in the fibrous sheet was 40%. This fibrous sheet was sliced, followed by buffing for napping to give a substrate cloth with a thickness of 0.8 mm.

The substrate cloth obtained was dyed in the same manner as in Example 1 using a disperse dye and again buffed for finishing. The finished leather-like sheet material had a novel feeling and a deep, dark color and looked suede-like. The K/S of that sheet was 25 and the color fastness to washing was excellent, namely ranked class 5 for each of the case in which a cotton cloth was used as a standard adjacent fabric and the case in which a nylon cloth was used as a standard adjacent fabric. The sheet had a thickness of 0.8 mm, a basis weight of 172 g/m$^2$ and a bulk density of 0.22 g/cm$^3$ and, when compared with the sheet obtained from a conventional polyester or nylon, it was less in basis weight and bulk density and was thus very lightweight. Further, it had a tensile strength of 15.5 kg/25 cm, a tensile elongation of 74% and a tear strength of 9.8 kg/500 g basis weight, hence it had also sufficient mechanical characteristics.

Obviously, numerous modifications and variations of the present invention are possible in light of the above teachings. It is therefore to be understood that within the scope of the appended claims, the invention may be practiced otherwise than as specifically described herein.

This application is based on Japanese patent application JP 70174/2000, filed Mar. 14, 2000, the entire contents of which are hereby incorporated by reference, the same as if set forth at length.

What is claimed is:

1. A fiber, comprising:

2 to 95% by weight, based on the total weight of the fiber, of at least one block copolymer, comprising:

at least one polymer block (A) comprising 50 to 100% by weight of olefinic monomer units, based on the total weight of said block copolymer; and at least one polymer block (B) comprising 0.1 to 100% by weight of (meth)acrylic monomer units, based on the total weight of said block copolymer.

2. The fiber according to claim 1, wherein the polymer block (A) comprises not more than 50% by weight of at least one vinyl monomer unit copolymerizable with said olefinic monomer units.

3. The fiber according to claim 1, wherein the polymer block (B) comprises not more than 99.9% by weight of at least one vinyl monomer unit copolymerizable with said (meth)acrylic monomer units.

4. The fiber according to claim 1, wherein the polymer block (A) has a number average molecular weight of 1,000 to 100,000.

5. The fiber according to claim 1, wherein the polymer block (B) has a number average molecular weight of 1,000 to 100,000.

6. The fiber according to claim 1, wherein a weight ratio (A):(B) between the polymer block (A) and polymer block (B) in the block copolymer ranges from 10:90 to 90:10.

7. A fibrous structure, comprising the fiber according to claim 1.

8. A non-woven fabric, comprising the fiber according to claim 1.

9. A leather-like sheet material, comprising:

a fibrous structure comprising the fiber according to claim 1; and an elastomeric polymer impregnated in said fibrous structure.

10. A dyed article, comprising the fiber according to claim 1 and a dye.

11. A process for producing a fiber, comprising melt spinning a composition comprising:

of at least one block copolymer, comprising:

at least one polymer block (A) comprising 50 to 100% by weight of olefinic monomer units, based on the total weight of said block copolymer; and at least one polymer block (B) comprising 0.1 to 100% by weight of (meth)acrylic monomer units, based on the total weight of said block copolymer;

to produce a fiber.

12. The process according to claim 11, wherein said block copolymer is present in said fiber in an amount of 2 to 95% by weight, based on the total weight of the fiber.

13. A composite fiber, comprising:

80 to 20% by weight of a polymer composition, based on the total weight of said fiber; and 20 to 80% by weight of a thermoplastic polymer, based on the total weight of said fiber;

wherein said polymer composition comprises 2 to 95% by weight, based on the total weight of said polymer composition, of at least one block copolymer, comprising:

at least one polymer block (A) comprising 50 to 100% by weight of olefinic monomer units, based on the total weight of said block copolymer; and at least one polymer block (B) comprising 0.1 to 100% by weight of (meth)acrylic monomer units, based on the total weight of said block copolymer.

14. The composite fiber according to claim 13, wherein the thermoplastic polymer is a polyester.

15. A fibrous structure, comprising the composite fiber according to claim 13.

16. A non-woven fabric, comprising the composite fiber according to claim 13.

17. A dyed article, comprising the composite fiber according to claim 13 and a dye.

* * * * *